US006009713A

United States Patent [19]

Horn

[11] Patent Number: 6,009,713

[45] Date of Patent: Jan. 4, 2000

[54] APPENDAGE, HAND AND FOOT COOLING APPARATUS

[76] Inventor: Stephen T. Horn, 1661 James Wharf Rd., White Stone, Va. 22578

[21] Appl. No.: 08/858,981

[22] Filed: May 20, 1997

[51] Int. Cl.[7] ..... F25D 17/06

[52] U.S. Cl. ..... 62/89; 62/259.3; 2/161.6; 307/111

[58] Field of Search ..... 62/259.3, 89; 2/160, 2/161.6, 16; 607/104, 111; 454/370

[56] References Cited

U.S. PATENT DOCUMENTS

| | | | |
|---|---|---|---|
| 2,460,269 | 2/1949 | Appeldoorn | 62/259.3 |
| 3,049,896 | 8/1962 | Webb | 62/259.3 |
| 3,744,053 | 7/1973 | Parker . | |
| 4,738,119 | 4/1988 | Zafred . | |
| 4,949,375 | 8/1990 | Nathans . | |
| 4,964,282 | 10/1990 | Wagner . | |
| 4,998,415 | 3/1991 | Lalsen . | |
| 5,255,390 | 10/1993 | Gloss et al. . | |
| 5,367,788 | 11/1994 | Chen . | |
| 5,438,707 | 8/1995 | Horn . | |

*Primary Examiner*—Joohn M. Sollecito

[57] ABSTRACT

The present invention provides a body cooling garment to easily and effectively cool the human body. By pressurizing air or other compressible gases to a minimum pressure rating of 70 psi and channeling it by means of a tubing network that is incorporated into body garments such as vest, head covers, and pants, the pressurized air can be transported and dispensed on the individual. Thus a two fold cooling affect is accomplished. First, initial cooling is achieved by the cooling of the pressurized gas itself as it rapidly depressurizes and expands though openings in the tubing resulting is a very cold gas. This affect combined with the flow of air and gases that is created by this expansion of pressurized gas in the vicinity of the body of an individual wearing such a garment will evaporatively cool the body and compliment the cooling caused by the rapid depressurization of the compressed gas.

3 Claims, 1 Drawing Sheet

APPENDAGE, HAND AND FOOT COOLING APPARATUS

FIELD OF THE INVENTION

The present invention relates to body garments specifically gloves or shoes capable of cooling the body's appendages.

DESCRIPTION OF THE PRIOR ART

Body garments for the purpose of cooling appear in the patent record taking many shapes and forms. However, most of these patents regard body garments that cool through the circulation of a cool liquid through a piping network incorporated into a garment or through the specially constructed garment itself having its own circulatory network. The major focus of prior art is in cooling the torso not the hands or feet of the user. None particularly address cooling appendages of the body but rather they tend to concentrate on cooling the chest. These devices are open systems, as opposed to the closed systems mentioned above, that release cool air or vapor onto and over an individuals body to cool through evaporative means. The present invention works by transfer of heat to the flowing gas from the appendage or covering, rapidly depressurizing gas, preferably air, in the inner portion of a glove or shoe in the area between the glove and the appendage arm or leg and through evaporative cooling. It also cools by transfer and removal of heat radiating from any protective glove or shoe that covers the appendage for protection, to the gas and out the glove openings. No gloves for active cooling are know by the inventor. For argumentative purposes the prior art is presented as follows.

U.S. Pat. No. 3,507,321, issued to James R. Palma on Apr. 21, 1970, discloses clothing for cooling and heating the body. Palma's clothing affects the human body from the neck down by strategically locating heating coils and cooling conduits through the clothing. Temperature sensors are also incorporated into the clothing for accurate, electrical temperature control of the clothing.

U.S. Pat. No. 3,570,264, issued to Daniel L. Curtis on Mar. 16, 1971, discloses an evaporant cooling system comprising a light weight garment having a plurality of tubes connected in a parallel arrangement within the garment for the purposes of cooling the individual wearing same. This invention includes an inlet and an outlet manifold for circulating a liquid water-ammonia solution from a storage tank through the tubes. An exhaust port is also seen in fluid communication with the tubing for allowing the expended evaporant, the ammonia, to leave the system and further cool the individual. U.S. Pat. No. 3,610,323, issued to Dan E. Troyer on Oct. 5, 1971, also discloses an evaporative cooling garment to be worn by an individual.

Although the above mentioned two systems have means for bleeding off and releasing evaporated liquid and gas from within the cooling system, they do not teach a fully gas cooling gloves shoes or appendage cover capable of cooling by the transfer of heat to the gas or of rapid depressurization and expansion of a gas to reduce the temperature of the air between a body garment and the body of the individual wearing such a garment. Nor do they teach a tubing network extending into the hands or feet. They do not teach the method of providing comfort to the appendages by removing humidity or cooling the outer covering or the appendage itself by the flow of the gas. For this reason, it is stated that these references do not teach the present invention.

U.S. Pat. No. 3,744,053, issued to Eugene K. Parker on Jul. 10, 1973, discloses liquid loop garments for heating and cooling the body of and individual. This system is a closed system, releasing no liquid or gas for either heating or cooling purposes. Parker's garments are constructed of two, liquid impervious, materials layers having insulation as well as other materials attached thereto.

Jumping ahead to U.S. Pat. No. 4,949,375, issued to Robert L. Nathans on Dec. 25, 1990, we see a mat utilizing the same type of closed system for circulating a fluid for cooling purposes that was disclosed in the Parker patent.

U.S. Pat. No. 4,998,415, issued to John D. Larsen on Mar. 12, 1991, discloses a body cooling apparatus including a tubing system for circulating a fluid that is moved not only through the tubing within the apparatus but through a compressor and a condenser in order to remove heat away from the body of an individual wearing the apparatus. Larsen's apparatus also includes a head cooling apparatus integrally connecting to the tubing of the main, body supported, apparatus for cooling the head of an individual.

Although tubing for circulating fluids about an individual are seen in these above mentioned patent references, they do not disclose a system that is capable of lowering temperatures in a glove through the transfer of heat from the appendage to the gas or cooling the surrounding air through rapid depressurization of a gas nor do they disclose a system which will cool an appendage by evaporative cooling.

U.S. Pat. No. 4,964,282, issued to Christopher S. Wagner on Oct. 23, 1990, discloses a detachable bulletproof vest air conditioning apparatus. Wagner's apparatus comprises a piping system that connects to a pre-cooled air source and ducts and channels the air into the interior of the vest, between the vest and the individual, to cool the wearer of said vest. There is no mention of gloves or of shoes or method of cooling such.

U.S. Pat. Nos. 5,062,269 and 5,146,625 disclose body cooling devices that utilize disposable and removable cooling units.

U.S. Pat. No. 4,738,119 issued to Paolo R. Zafred on Apr. 19, 1988 discloses a garment arrangement where insulated lining material is stitched together to form pockets where tubes are placed to receive liquid carbon dioxide which then converts to solid carbon dioxide ,dry ice, and then sublimates. This garment works much like an "ice vest " with the exception that frozen carbon dioxide is used rather than frozen water. According to Zafred it works by "connective and conductive cooling of the wearer". No discussion of gloves or shoes is shown only a discussion of the torso. Zafred does not disclose a system operated by readily available compressed air nor does he disclose a system whereby the back pressure maintained by the apparatus cools the air below ambient temperature. Zafred does not allow for evaporative cooling and its subsequent removal of moisture.

U.S. Pat. No. 5,255,390 issued to Stanford A Gross and Stanley Bauman on Oct. 26, 1993 Gross's apparatus is a gas ventilated garment which is connected through a plurality of gas conduits to various locations to slowly release air adjacent to the body of the wearer. "Individual radial valves are adapted to release the pressurized gas at extremely low rates". In the preferred configuration the only cooling that is mentioned is in conjunction with the use of a "wicking" garment which will "gather and hold the moisture from perspiration of the user 12 immediately adjacent the skin of this user." Gross makes no claims in which the garment is described other than a "ventilation garment". No claim is made as to cooling the air around the individual. Gross makes no claims in which a garment does not have a "low gas consumption valuing configuration". No disscussion of gloves or shoes is present. No provision for back pressure in the system is made. No attempt to capitalize on Charles Law is made. The system is designed to trap ventilated air, not large scale evaporant cooling. "Preferably this jacket chamber includes elastic members 62 at the neck and wrists and can also include a drawstring 58 at the waist of a user. In this manner an air chamber will be defined adjacent to the body of a user 12 for retaining of the ventilation gas released . Therefore no cooling of the outer appendage garment is possible.

The Personal Cooling and Heating Systems of VORTEC CORPORATION present air cooling body apparatus. They simply pump expanded and cooled air into the vest and helmet from an expansion chamber outside a vest. There is no mention of gloves or shoes.

U.S. Pat. No. 5,438,707 issued to Stephen T. Hom on Aug. 8 1995 describes a cooling garment using the direct expansion of compressed air. There is no mention of cooling appendages by the non expansive use of air or cooling appendages at all.

U.S. Pat. No. 5,367,788 issued to Shi-hiu Chen on Nov. 29 1994 describes a cooling shoe. No introduction of a gas or tubing is shown. Nor is any tubing network used in this device. The air used in this device is at atmospheric pressure and therefore does not flow past the foot. This invention requires cooled air rather than relying on the ambient temperature and significant flow of the gas coming from the compressor. Nor does this device provide any active method of removing the evaporative moisture of the foot.

None of the above inventions and patents, taken either singly or in combination, is seen to describe the invention as claimed.

SUMMARY OF THE INVENTION

Accordingly, it is a principal object of the invention to provide a convenient and inexpensive cooling to the appendages or extremities of the body by the flow of gas over the extremity. Heat would transfer from the warm appendage and the warm glove or covering to the gas and be removed from the hand or appendage as the gas exits the glove. It is another object of the invention to accomplish the above mentioned task by means of a cooling apparatus that utilizes the affects of rapid depressurization and expansion of a compressed gas to cool the appendage of an individual by reducing the temperature of the surrounding air due to the infusion of a pressurized gas that is both expanding and cooling at the same time.

It is a further object of the invention to provide inexpensive and substantial cooling to the hands or feet of an individual by utilizing complementary cooling effects such as evaporative cooling that are present due to the circulation of a gas or air within the apparatus as it exits from a tubing network within the glove or appendage cover. It is an object to cool by the above methods the glove itself and thus remove the heat and prolong the life of the glove or shoe.

It is an object of the invention to provide improved elements and arrangements thereof in an apparatus for the purposes described which is inexpensive, dependable and fully effective in accomplishing its intended purposes. The utility of the present invention is in it's ability to allow the manipulation of hot objects in the manufacturing environment with the hands or stand on very hot surfaces and to keep people in hot environments comfortable and productive.

These and other objects of the present invention will become easily apparent upon further review of the following specification and drawings.

DETAILED DESCRIPTION OF THE PREFERRED EMBODIMENT(s)

Figure 1:
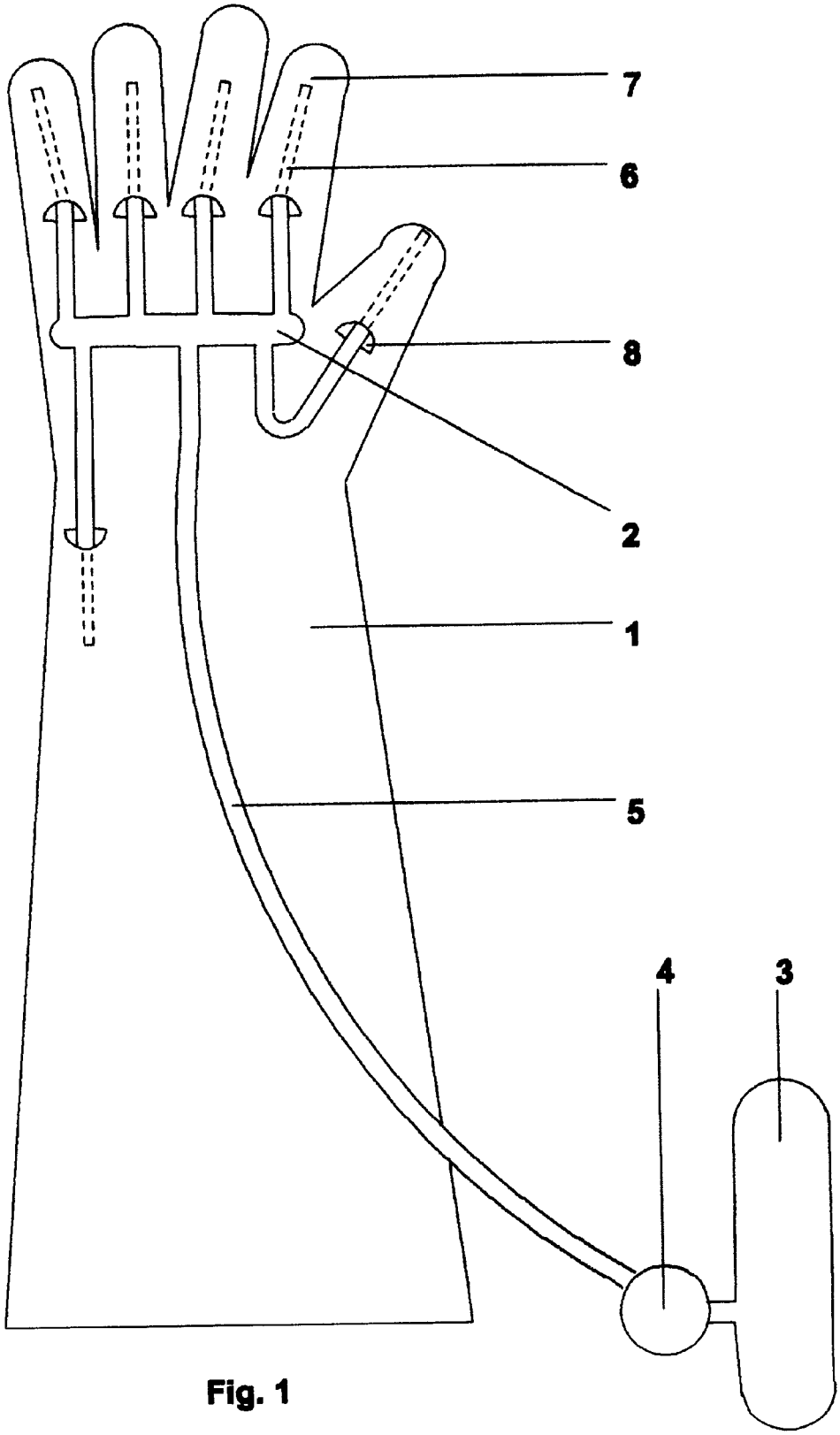
FIG. 1 is a glove with a manifold for the distribution of gas to the fingers. Tubes run through slits to the interior of the glove. The manifold is connected to a compressed gas source.

The present invention relates to body appendage cooling such as gloves or boots. It cools the hand or arm by the flow of gas past the appendage. The heat and humidity of the glove is thus removed. This product will be directed at the welding and foundry industries where hot parts are routinely handled. It will be used also in heavy fluxcore welding where operators routinely burn the backs of their hands from the radiant heat of the pool of molten medal in the weld. The glove envisioned could be worn under a heavy work glove for protection of the manifold and to provide further insulation to the hand. The glove 1 shown in FIG. 1, is temporarily attached to a manifold 2 . This is in turn attached to a source of gas 3 which would probably be air. The gas 3 is regulated by a valve 4 in communication through tube 5 to the manifold 2. The manifold 2 is in communication with smaller tubes 6 which is open on the ends 7. The tubes 6 penetrates into the interior of the glove 1 through slits 8. Thus air or a gas entering the manifold 2 and exiting tubes 6 at ends 7 would flow back across the appendage and exit the glove 1 at the slits 8 transferring out considerable heat and humidity . The arrangement of tubes 6 and slits 8 attach manifold 2 temporarily to glove 1 due to the stiff but flexible nature of the plastic tubing. The gas entering the glove due to its expansion would also drop in temperature further adding to the effective cooling. This would be enhanced by maintaining back pressure in the tubing by ensuring that the total flow out of the ends of the tubes is less than the total flow of gas supplied to the manifold. Holes machined in the tubing for the exit of the gas is also envisioned especially to cool areas higher up on the arms or ankles. A further embodiment would be the use of a gas permeable glove which would allow the gas to exit through the glove itself rather than the slits 8 in the glove. Also a doubled wall glove could be used to distribute the gas with the gas permeable fabric on the inside of the glove and a sealed glove on the outside. The gas would exit either around the hand in this case and out the cuff or a suitable exit could be supplied. Another refinement is the manufacture of the glove as a glove liner where the glove is silk or some other thin material and the tubing network is attached to or fitted in pockets along the fingers. The glove liner would be used in conjunction with a heavy outer glove. The glove liner would then provide cooling to the outer glove and hand. The operator could choose which outer glove is most suitable to the job. Another refinement would be to attach the manifold to a stiff cuff and have the tubes fit in pockets of a thin silk like glove liner. This thin glove could be hook loop attached to the cuff so as to make the thin glove replaceable. This would be important as the thin glove would tend to wear.

It is to be understood that the present invention is not limited to the sole embodiment described above, but encompasses any and all embodiments within the scope of the following claims.

I claim:

1. A method of cooling a hand comprising the following steps:

(a) supplying a gas through a tube to said hand, wherein said hand and supply end of said tube are enclosed in a glove (b) flowing said gas in said glove and around said hand so that said gas transfers heat from said hand and said glove to said gas and then flows to an exit opening in said glove, thereby cooling said hand.

2. A hand cooling apparatus that includes a gas permeable inside glove, an outside glove and a gas supply tube connected to an envelop formed between the two gloves, where a restriction of gas flow through the gas permeable glove maintains pressure in said gas supply tube resulting in expansion and temperature drop of said gas escaping through said gas permeable inside glove thereby cooling said hand.

3. The hand cooling apparatus as in claim 1 wherein a tubing network is attached to the inside of the outside glove.

* * * * *